US005232821A

United States Patent [19]

Merkel et al.

[11] Patent Number: 5,232,821

[45] Date of Patent: Aug. 3, 1993

[54] PHOTOGRAPHIC COUPLER COMPOSITIONS CONTAINING BALLASTED SULFOXIDES AND SULFONES AND METHODS

[75] Inventors: Paul B. Merkel, Rochester; Edward Schofield, Penfield, both of N.Y.

[73] Assignee: Eastman Kodak Company, Rochester, N.Y.

[21] Appl. No.: 678,427

[22] Filed: Apr. 1, 1991

[51] Int. Cl.[5] ..... G03C 1/33; G03C 1/34; G03C 7/38; G03C 7/392

[52] U.S. Cl. ..... 430/372; 430/377; 430/386; 430/387; 430/428; 430/429; 430/546; 430/554; 430/555; 430/558; 430/551

[58] Field of Search ..... 430/551, 546, 558, 554, 430/555, 372, 377, 386, 387, 427, 428, 429, 430, 431

[56] References Cited

U.S. PATENT DOCUMENTS

| | | | |
|---|---|---|---|
| 3,625,699 | 12/1971 | Stewart et al. | 430/377 |
| 4,046,568 | 9/1977 | Greenwald | 430/428 |
| 4,047,954 | 9/1977 | Greenwald | 430/428 |
| 4,113,488 | 9/1978 | Yamada et al. | 430/551 |
| 4,419,431 | 12/1983 | Lischewski et al. | 430/179 |
| 4,686,177 | 8/1987 | Aoki et al. | 430/553 |
| 4,758,498 | 7/1988 | Harada et al. | 430/216 |
| 4,770,987 | 9/1988 | Takahashi et al. | 430/546 |
| 4,993,271 | 6/1990 | Rody et al. | 430/512 |
| 5,047,315 | 9/1991 | Morigaki et al. | 430/544 |
| 5,068,171 | 11/1991 | Morigaki et al. | 430/9 |
| 5,070,007 | 12/1991 | Rody et al. | 430/551 |
| 5,082,766 | 1/1992 | Nishijima et al. | 430/551 |

FOREIGN PATENT DOCUMENTS

| | | |
|---|---|---|
| 61-51063 | 3/1986 | Japan . |
| 3039950 | 2/1991 | Japan . |

*Primary Examiner*—Lee C. Wright

*Attorney, Agent, or Firm*—Lowe, Price, LeBlanc & Becker

[57] ABSTRACT

Photographic coupler compositions comprise (a) a magenta dye-forming coupler compound, and (b) a sulfoxide compound or a sulfone compound in an amount sufficient to improve the light stability of a magenta dye formed from the magenta dye-forming coupler compound. The sulfoxide compound is of the formula and the sulfone compound is of the formula wherein $R_1$ and $R_2$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl, acyloxy, carbonamido and carbamoyl groups and halogen atoms; a phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms. Additionally, $R_1$ and $R_2$ combined contain at least 12 carbon atoms. The photographic coupler compositions are free of phenol compounds.

28 Claims, No Drawings

PHOTOGRAPHIC COUPLER COMPOSITIONS CONTAINING BALLASTED SULFOXIDES AND SULFONES AND METHODS

FIELD OF THE INVENTION

The present invention relates to photographic coupler compositions which comprise a magenta dye-forming coupler compound and a sulfoxide compound or a sulfone compound which improves the light stability of a magenta dye formed from the magenta dye-forming coupler compound. The invention also relates to color photographic materials including such coupler compositions, methods for improving the light stability of a magenta dye, and methods for the formation of color images, which methods employ the novel coupler compositions of the invention.

BACKGROUND OF THE INVENTION

It is well known in the color photography art that color images are produced by a colored dye which is formed by a coupling reaction between an oxidized product of an aromatic primary amine color developing agent and a coupler. Various types of cyan, magenta and yellow dye-forming couplers are well known for use in such coupling reactions. The couplers are often used in combination with one or more solvents and/or other additives. For example, the Aoki et al. U.S. Pat. No. 4,686,177 discloses silver halide color photographic materials containing a cyan coupler which may be dissolved in an organic solvent. Aoki et al. broadly disclose numerous organic solvents which may be employed. Japanese reference No. 61-51063 discloses compositions in which a coupler is dissolved in an organic solvent such as dimethylsulfoxide.

It is often desirable in color photography to provide the coupler compounds with improved properties, for example with improved coupler activity, i.e., improved colorability as indicated by acceleration of the reaction of the coupler with the oxidized developer in forming the color dye and/or by an increase in the color density of the resulting colored dye. It is also desirable to provide the dye which is formed from the reaction of the coupler compound with the oxidized developer with improved light stability. For example, the Yamada et al. U.S. Pat. No. 4,113,488 discloses a method for improving the light fastness of a magenta color image by incorporating into a layer containing the magenta color image at least one light fastness improving phenolic compound and at least one synergistic light fastness improving sulfide or sulfoxide compound.

The Takahashi et al. U.S. Pat. No. 4,770,987 discloses silver halide color photographic materials which contain a magenta coupler and an antistain agent in the form of lipophilic fine particles. The antistain agent comprises a sulfone compound and the material is disclosed as preventing stain formation on the non-color developed areas due to aging and the like after processing. The Lischewski et al. U.S. Pat. No. 4,419,431 discloses compositions comprising a light-sensitive diazonium compound and a sulfide, sulfoxide or sulfone compound for increasing the light stability of an azo image dye stuff formed by light imaging and development of the composition. The Hirata et al. U.S. Pat. No. 4,758,498 discloses photographic compositions including a sulfone compound for preventing fading of an image dye and staining of white background areas.

Many coupler compositions, however, are disadvantageous in that relatively large amounts of a coupler are required to provide satisfactory color density, the reaction rate of the coupler with the oxidized developer is undesirably low, the colored image which is formed from the reaction of the coupler compound with the oxidized developer exhibits unacceptable light instability, and/or the like. Accordingly, a continuing desire exists for coupler compositions of improved properties for use in color photographic materials and methods.

SUMMARY OF THE INVENTION

Accordingly, it is an object of the present invention to provide novel coupler compositions for use in color photography. It is a more specific object of the invention to provide coupler compositions which form color images by reaction with oxidized developer, which color images exhibit improved light stability and resistance to fading. It is a further object of the invention to provide coupler compositions which form color images of improved light stability and which produce hypsochromic shifts in the formed dye hues. It is another object of the invention to provide coupler compositions which form color images having improved light stability and which exhibit reduced speed losses during development. It is a related object of the invention to provide methods for forming coupler compositions which produce color images having improved light stability. Additional objects of the invention also include the provision of improved silver halide color photographic materials and improved methods for the formation of color images.

These and additional objects are provided by the photographic coupler compositions according to the present invention which comprise a magenta dye-forming coupler compound and a sulfoxide compound or a sulfone compound in an amount sufficient to improve the light stability of a magenta dye formed from the magenta dye-forming coupler compound. The sulfoxide compound is of the formula

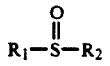

and the sulfone compound is of the formula

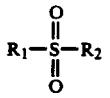

wherein $R_1$ and $R_2$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl, acyloxy, carbonamido and carbamoyl groups and halogen atoms; a phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined contain at least 12 carbon atoms. The photographic coupler compositions are free of simple phenol compounds.

It has been discovered that the sulfoxide and sulfone compounds employed in the coupler compositions of the present invention provide improved light stability to magenta color images formed from magenta dye-forming coupler compounds, and particularly provide improved light stability to magenta color images formed from pyrazolotriazole magenta dye-forming coupler compounds. Additionally, the sulfoxide and sulfone compounds included in the compositions of the present invention, at least in some applications, produce hypsochromic shifts in dye hues and/or reduce speed losses which may otherwise occur with the coupler compound, particularly with the pyrazolotriazole magenta dye-forming coupler compounds. The coupler compositions of the present invention are therefore suitable for use in improved silver halide color photographic materials and in improved methods for the formation of color images.

These and additional advantages will be more fully apparent in view of the following detailed description.

DETAILED DESCRIPTION

The photographic coupler compositions according to the present invention comprise a magenta dye-forming coupler compound and a sulfoxide compound or a sulfone compound in an amount sufficient to improve the light stability of a magenta dye formed from the magenta dye-forming coupler compound. The improved light stability exhibited by the color images formed from the present compositions provides improved color photographic materials. As will be set forth in further detail below, at least in some cases, the sulfoxide and sulfone compounds included in the compositions of the present invention provide the coupler compositions with reduced speed losses which occur during development and/or produce desirable hypsochromic shifts in dye hues.

The sulfoxide compounds and sulfone compounds which are employed in the coupler compositions of the present invention may serve as solvents for the coupler compounds and/or may be used in combination with other solvents. It is important that the sulfoxide and sulfone compounds employed in the present invention contain sufficient ballast to minimize their water solubility, volatility and diffusivity. Suitable sulfoxide compounds for use in the coupler compositions of the present invention are of the formula

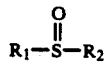

while the sulfone compound suitable for use in the compositions of the present invention are of the formula

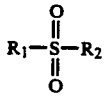

wherein $R_1$ and $R_2$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl, acyloxy, carbonamido and carbamoyl groups and halogen atoms; a phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined contain at least 12 carbon atoms.

In preferred embodiments of the sulfoxide compound or the sulfone compound which is included in the coupler compositions of the present invention, $R_1$ and $R_2$ are individually selected from the group consisting of straight and branched chain alkyl groups, alkenyl groups and alkylene groups. For example, $R_1$ and $R_2$ may be the same, thereby forming a bis compound, or $R_1$ and $R_2$ may, together with the sulfur atom, form a ring. In a further preferred embodiment, $R_1$ and $R_2$ combined contain at least 14 carbon atoms, and more preferably from about 16 to about 24 carbon atoms. In an additionally preferred embodiment, $R_1$ and $R_2$ each comprise a branched alkyl group.

Examples of suitable sulfoxide compounds and sulfone compounds for use in the coupler compositions of the present invention include, but are not limited to, the following:

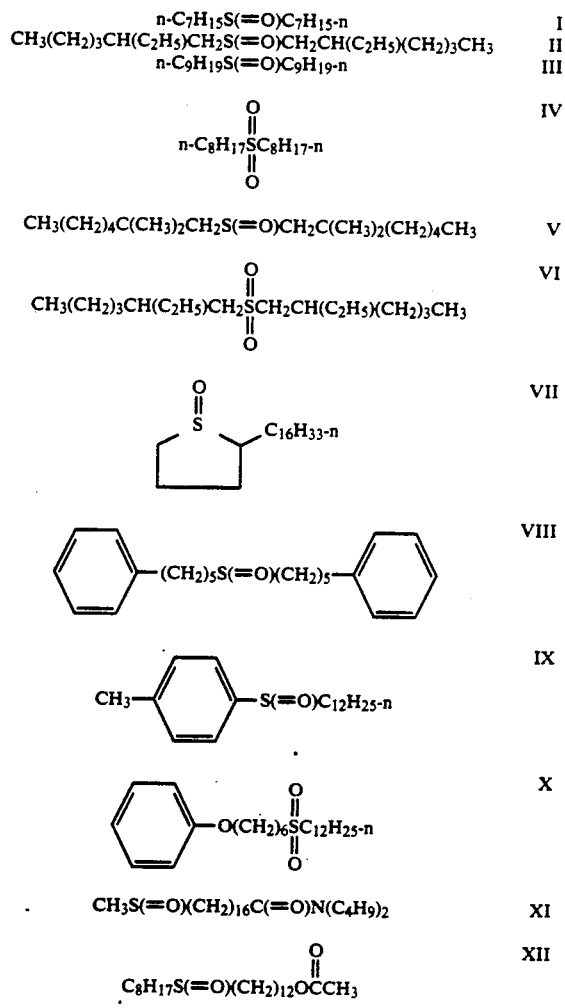

The photographic coupler compositions according to the present invention are free of phenol compounds. The present inventors have discovered that surprisingly the coupler compositions according to the present invention containing the magenta dye-forming coupler compound and the sulfoxide or sulfone compound provide color images having improved light stability in the absence of light stability improving phenol compounds employed in the prior art.

As noted above, the sulfoxide and sulfone compounds employed in the coupler compositions of the present invention may act as a solvent for the dye-forming coupler. One or more additional organic solvents for the coupler compound may also be employed in the compositions of the present invention. Generally, conventional organic coupler solvents are known in the art and may be employed when the sulfoxide and sulfone compounds of the present invention are used in an additive amount which is not sufficient to result in a solution of the coupler compound. Examples of conventional organic solvents which may be used in the present compositions are described in the Examples set forth below.

The sulfoxide and sulfone compounds are employed in the coupler compositions of the present invention in an amount sufficient to improve light stability of a magenta dye formed from the dye-forming coupler. In most applications, it is preferred that the dye-forming coupler and the sulfoxide or sulfone compound are employed in a weight ratio of from about 1:0.1 to about 1:10 in order to effect an increase in the aforementioned light stability.

As noted above, it is preferred that the dye-forming coupler included in the present coupler compositions comprises a magenta dye-forming coupler. Couplers which form magenta dyes upon reaction with oxidized color developing agents are well known in the art and are described in such representative patents and publications as: U.S. Pat. Nos. 2,600,788; 2,369,489; 1,969,479; 2,311,082; 3,061,432; 3,725,067; 4,120,723; 4,500,630; 2,343,703; 2,311,082; 3,152,896; 3,519,429; 3,062,653; 2,908,573; 4,774,172; 4,443,536; 3,935,015; 4,540,654; 4,581,326; European Patent Applications 284,239; 284,240; 240,852; 170,164; 177,765 and "Farbkuppler-eine Literaturübersicht," published in Agfa Mitteilungen, Band III, pp. 126–156 (1961), the disclosure of which are incorporated herein by reference.

Preferred magenta dye-forming couplers for use in the present compositions comprise pyrazolotriazole compounds of the general formulae:

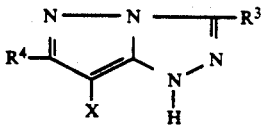

(M-1)

and

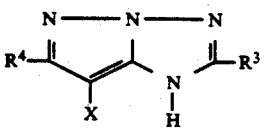

(M-2)

wherein $R^3$ and $R^4$ are individually selected from the group consisting of hydrogen, substituted and unsubstituted alkyl, substituted and unsubstituted phenyl, substituted and unsubstituted alkoxy, substituted and unsubstituted amino, substituted and unsubstituted anilino, substituted and unsubstituted acylamino, halogens and a group which links to a polymer, provided that the total number of carbon atoms contained in $R^3$ and $R^4$ is at least 10 if neither $R^3$ nor $R^4$ is a group which links to a polymer; and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups. Coupling-off groups are well known to those skilled in the photographic art. Generally, such groups determine the equivalency of the coupler and modify the reactivity of the coupler. Coupling-off groups can also advantageously effect the layer in which the coupler is coated or other layers in the photographic material by performing, after release from the coupler, such functions as development inhibition, bleach acceleration, color correction, development acceleration and the like. Representative coupling-off groups include, as noted above, halogens (for example, chloro), alkoxy, aryloxy, alkyl thio, aryl thio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,728; 1,531,927; 1,533,039; 2,006,755A and 2,017,704A, the disclosures of which are incorporated herein by reference.

As is well known in the photographic art, a coupler compound should be nondiffusible when incorporated in a photographic element. That is, the coupler compound should be of such a molecular size and configuration that it will exhibit substantially no diffusion from the layer in which it is coated.

To achieve this result, the total number of carbon atoms contained in $R^3$ and $R^4$ combined should be at least 10. Preferably, $R^3$ and $R^4$ combined contain from 10 to about 40 carbon atoms. Alternatively, $R^3$ or $R^4$ may serve as a link to or form part of a polymeric chain.

In preferred embodiments, the magenta dye-forming coupler compound is a pyrazolotriazole of formula (M-1) or (M-2) wherein X is a halogen atom, most preferably chlorine, $R^4$ is alkyl group, and/or the total number of carbon atoms contained in $R^3$ and $R^4$ is from 10 to about 40.

Suitable pyrazolotriazole magenta dye-forming coupler compounds for use in the compositions and methods of the present invention include, but are not limited to, the following compounds (m-i)–(m-xii):

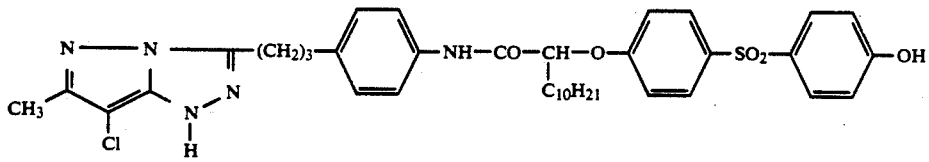

(m-i)

-continued
(m-ii)
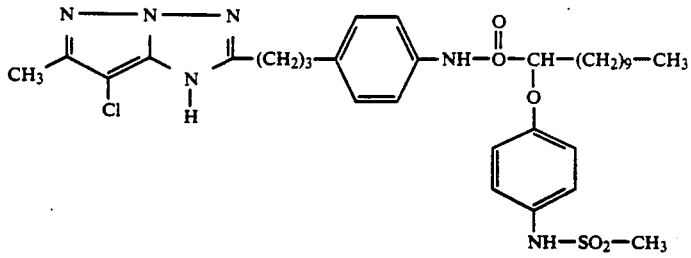
(m-iii)
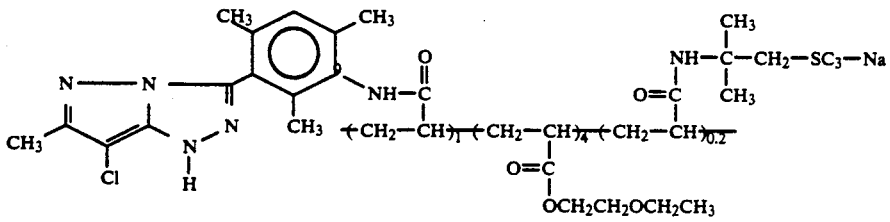
(m-iv)
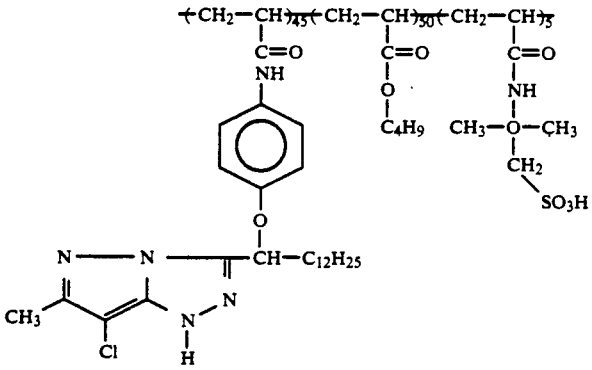
(m-v)
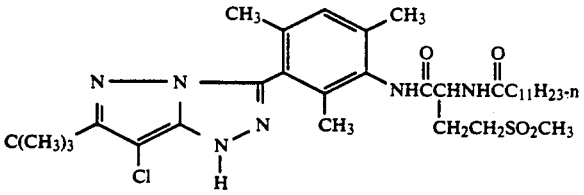
(m-vi)
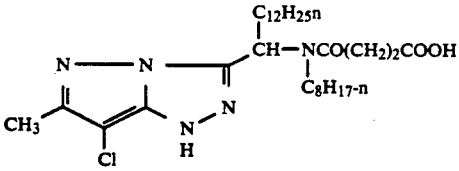
(m-vii)
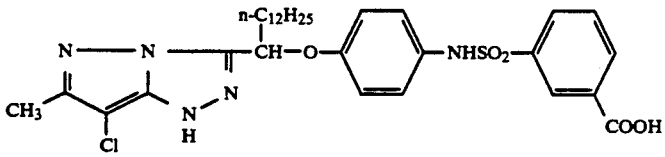
m-viii)
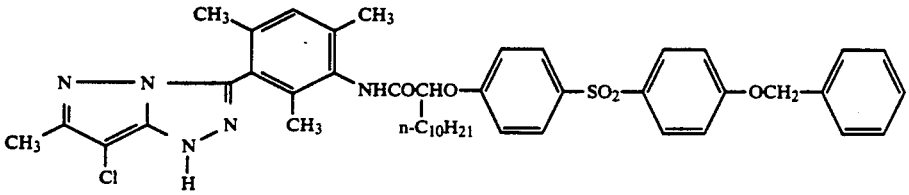

-continued (m-ix)

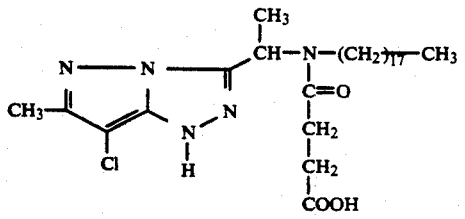

(m-x)

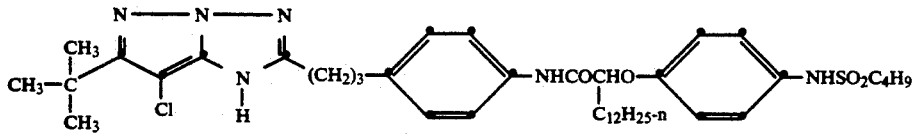

(m-xi)

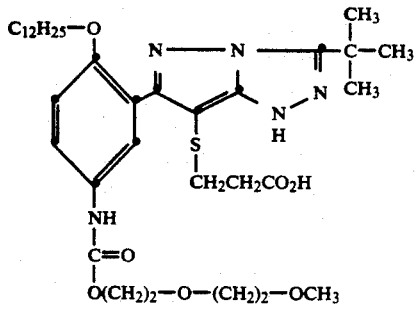

(m-xii)

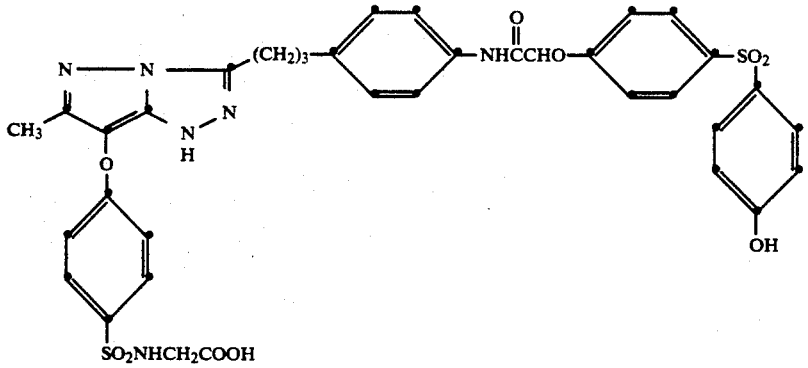

The photographic coupler compositions according to the present invention are employed in color photographic materials in a manner well known in the color photographic art. For example, a supporting substrate may be coated with a silver halide emulsion and the coupler composition of the present invention comprising a magenta dye-forming coupler compound and a sulfoxide compound or a sulfone compound in an amount sufficient to improve the light stability of a magenta dye formed from the coupler compound. The photographic material may then be imagewise exposed in a manner well known in the color photography art, followed by development with an aromatic primary amine developer. As is further well known in the art, the oxidation product of the aromatic primary amine developer reacts with the coupler compound to form the colored dye images.

Photographic elements in which the compositions of this invention are incorporated can be simple elements or multilayer, multicolor elements. The compositions of this invention can be incorporated into layers containing silver halide emulsions of a variety of types known in the art, such as fine or course grain emulsions, tabular grain emulsions, silver chlorobromide and silver bromoiodide emulsions. Useful tabular grain emulsions are described in *Research Disclosure*, Item 22534, January, 1983 and in U.S. Pat. No. 4,748,106. The layers in which the compositions of this invention are incorporated may also contain other coupler components, such as colored masking couplers, image-modifying couplers (including DIR's and timed or switched DIR's such as those described in U.S. Pat. Nos. 3,148,062, 3,227,554, 3,733,201, 4,409,323, and 4,248,962) and bleach accelerator releasing couplers (including those described in EP 193,389).

The coupler compositions according to the present invention may further include conventional additives, including certain light stabilizers such as alkoxybenzene derivatives, anilines and oxyanilines, if desired.

The compositions and methods of the present invention are demonstrated by the following examples in which references are to parts by weight unless otherwise specified. Throughout the examples, reference to coupler solvents (I)–(XII) refers to the sulfoxide and sulfone compounds (I)–(XII) set forth above while reference to standard coupler solvents S1 and S2 refers to conventional coupler solvents comprising mixed tritolyl phosphates and dibutyl phthalate, respectively.

EXAMPLE 1

Coupler compositions comprising emulsion dispersions of the coupler compound (m-i) as set forth above were prepared using sulfoxide and sulfone compounds (I)–(IV) according to the present invention as solvents and using conventional coupler solvents S1 and S2 for comparison purposes as set forth in Table I. Specifically, an oil phase was prepared by warming a mixture of 3.4 g of coupler compound (m-i), 1.7 g of the respective coupler solvent and 10.2 g of an auxiliary solvent comprising 2-(2-butoxyethoxy) ethyl acetate until dissolution was complete. The weight ratio of coupler compound to the non-auxiliary solvent was 1:0.5. The resulting solution was added to an aqueous solution containing 18.13 g of a 12.5 weight percent aqueous gelatin, 2.27 g of a 10% aqueous Alkanol XC solution and 2.08 g of water. The resulting mixture was then passed through a colloid mill three times to disperse the oil phase and the resulting dispersion was chilled, noodled and washed for four hours at 40° C. to remove the auxiliary solvent. The resulting dispersed coupler composition was then coated on a cellulose acetate butyrate support at a level of $1.5\times10^{-4}$ moles/ft$^2$ (108 mg/ft$^2$) together with a sensitized silver bromoiodide emulsion (approximately 0.55, 12% iodide) in the following format:

| | |
|---|---|
| Gelatin | 250 mg/ft$^2$ |
| Hardener | 1.75% of total gel |
| Gelatin | 350 mg/ft$^2$ |
| Coupler (m-i) | $1.5\times10^{-4}$ mole/ft$^2$ |
| Coupler Solvent | 1:0.5 (w/w) |
| Silver Halide Emulsion | 84.2 mg/ft$^2$ |
| Tetraazaindine | 175 g/mole Ag |
| Support | |

Hardened film strips of the resulting product were exposed (1/25 sec, 1B sensitometer) through a step tablet and then subjected to the Kodak Flexicolor commercial development process. The status M green densities of the processed films were measured both before and after exposure to one week of unfiltered 5.4 Klux daylight irradiation. A percent fade was determined by comparing the status M green densities after irradiation to those before irradiation at an initial density of approximately 1.0. The percent fade values are set forth in Table I. Also set forth in Table I are values of the wavelength of maximum absorption (k max) which were measured on a spectrophotometer. As shown in Table I, the coupler solvents were evaluated in two separate coating sets, A and B.

TABLE I

| | Coupler Solvent | % Fade | λmax (nm) |
|---|---|---|---|
| Set A: | S1 | 40 | 555 |
| | S2 | 46 | 556 |
| | II | 31 | 553 |
| Set B: | S1 | 44 | 554 |
| | S2 | 42 | 555 |
| | I | 28 | 553 |
| | II | 35 | 553 |
| | III | 27 | 554 |
| | IV | 32 | 554 |

The results set forth in Table I demonstrate that the coupler compositions according to the present invention containing a sulfoxide compound or a sulfone compound in combination with the magenta dye-forming coupler provided a color image which exhibited improved light stability, as indicated by a reduced percent fade, as compared with that formed from the compositions containing the conventional coupler solvents. In addition, the color images formed from the coupler compositions according to the present invention exhibited slight hypsochromic shifts in dye hue. These shifts can lessen unwanted absorption of red light by the magenta dye.

EXAMPLE 2

Coupler compositions comprising emulsion dispersions of the coupler compound (m-ii) as set forth above were prepared using a sulfoxide compound according to the present invention and using conventional coupler solvents for comparison purposes as set forth in Table II. Specifically, an oil phase comprising 0.90 g of the coupler compound (m-ii), 0.90 g of the respective coupler solvent and 2.70 g of the auxiliary solvent described in Example 1 was added to an aqueous phase comprising 7.20 g of a 12.5% aqueous gelatin, 0.90 g of a 10% aqueous Alkanol XC solution and 2.40 g of water. The weight ratio of coupler compound to the non-auxiliary coupler solvent was 1:1. The mixture was passed through a colloid mill to disperse the oil phase, and the resulting dispersion was then coated at a level of $1.0\times10^{-4}$ moles/ft$^2$ (65.7 mg/ft$^2$) with 84.2 mg/ft$^2$ of the silver bromoiodide emulsion described in Example 1 in the following format:

| | |
|---|---|
| Gelatin | 250 mg/ft$^2$ |
| Hardner | 1.75% of total gel |
| Gelatin | 350 mg/ft$^2$ |
| Coupler (m-ii) | 65.7 mg/ft$^2$ |
| Coupler Solvent | 65.7 mg/ft$^2$ |
| Silver Halide Emulsion | 84.2 mg/ft$^2$ |
| Tetraazaindine | 1.75 g/mole Ag |
| Support | |

The resulting film strips were exposed and processed in accordance with the procedures described in Example 1. Additionally, the percent fade values and the λmax values of the film strips were determined in accordance with the procedures described in Example 1. The resulting percent fade and λmax values are set forth in Table II.

TABLE II

| Coupler Solvent | % Fade | λmax (nm) |
|---|---|---|
| S1 | 5.4 | 556.3 |
| S2 | 6.5 | 556.2 |
| II | 2.2 | 553.7 |

The results set forth in Table II demonstrate that the coupler composition according to the present invention containing a sulfoxide compound produced a color image which exhibited significantly less fade as compared with the coupler compositions containing the conventional coupler solvents S1 and S2. Additionally, the dye hue exhibited by the color image formed from the coupler composition according to the present invention was also more hypsochromic (by about 2.5 nm) whereby unwanted red absorption by the magenta dye is reduced.

EXAMPLE 3

In this example, coupler compositions comprising emulsion dispersions of the polymeric coupler compound (m-iii) as set forth above were prepared using a sulfoxide compound according to the present invention and using conventional coupler solvents for comparison purposes as described in Table III. Specifically, dispersions of the coupler compound were prepared by milling 3.0 g of the respective coupler solvent and 1.1 g of ethylacetate with 15 ml of a 12.5% aqueous gelatin, 1.9 ml of a 10% aqueous Alkanol XC solution and 9.1 ml of water. Each of the respective coupler solvent dispersions were combined with a latex dispersion of the coupler compound (m-iii) to provide a weight ratio of coupler compound to solvent of 1:0.5. The resulting mixture was stirred for three hours at 40° C. to permit loading of the coupler solvent into the latex. The coupler solvent-loaded latex dispersions of polymeric coupler compound (m-iii) were coated at a level of $1.5\times10^{-4}$ moles/ft$^2$ together with the silver bromoiodide emulsion described in Example 1 in the following format:

| | | |
|---|---|---|
| Gelatin | 250 | mg/ft$^2$ |
| Hardener | 1.75% | of total gel |
| Gelatin | 350 | mg/ft$^2$ |
| Coupler (m-iii) | $1.5 \times 10^{-4}$ | mole/ft$^2$ |
| Coupler Solvent | 1:0.5 | (w/w) |
| Silver Halide Emulsion | 84.2 | mg/ft$^2$ |
| Tetraazaindine | 1.75 | g/mole Ag |
| Support | | |

Hardened film samples of the resulting product were processed in accordance with the procedures in Example 1. The percent fade and λmax for each sample were also determined in accordance with the procedures described in Example 1. The results of these measurements are set forth in Table III.

TABLE III

| Coupler Solvent | % Fade | λmax (nm) |
|---|---|---|
| S1 | 47.5 | 558.9 |
| S2 | 54.1 | 559.1 |
| II | 33.2 | 557.4 |

The results set forth in Table III again demonstrate that the coupler composition according to the present invention produced a magenta color image exhibiting improved light stability as compared with the color images formed from the coupler compositions containing the conventional coupler solvents. The magenta color image produced from the coupler composition according to the present invention also exhibited a desirable hypsochromic hue shift.

EXAMPLE 4

This example demonstrates the improvements in photographic speed provided by the coupler compositions of the present invention in a photographic developing process. The photographic speed was measured as the KIT speed, the Kontrast Independent Toe speed, a property which is known in the art and which is defined as the exposure where the density above Dmin is 0.20 times the average gradient from that point to 0.6 logE greater exposure. In forming color images, the dispersion, coating and processing procedures set forth in Example 1 were followed in preparing film strips from coupler compositions containing sulfoxide compound II and the conventional coupler solvents S1 and S2, respectively. The status M green densities were measured as a function of exposure and the KIT speeds were determined in accordance with the aforementioned definition. The KIT speed values are set forth in Table IV. The listed values represent an average of four separate determinations and have a standard deviation of 0.005 units.

TABLE IV

| Coupler Solvent | KIT Speed (log E) |
|---|---|
| S1 | 2.425 |
| S2 | 2.415 |
| II | 2.458 |

The results set forth in Table IV demonstrate that the coupler composition according to the present invention exhibited in increased KIT speed of 0.04 log E units, which signifies a significant improvement in photographic speed, as compared with the conventional compositions.

EXAMPLE 5

This example further illustrates the improvements in KIT speed as defined in Example 4 provided by the use of coupler compositions according to the present invention. Specifically, the dispersion, coating and processing compositions and procedures described in Example 2 were followed in forming film strips. The measured KIT speeds are set forth in Table V.

TABLE V

| Coupler Solvent | KIT Speed (log E) |
|---|---|
| S1 | 2.05 |
| S2 | 1.89 |
| II | 2.14 |

The results set forth in Table V further demonstrate the improvement in photographic speed provided by the use of the coupler composition according to the present invention as compared with the coupler compositions containing the conventional coupler solvents.

The preceeding examples are set forth to illustrate specific embodiments of the invention and are not intended to limit the scope of the compositions and methods of the present invention. Additional embodiments and advantages within the scope of the claimed invention will be apparent to one of ordinary skill in the art.

What is claimed is:

1. A color photographic material, comprising a supporting substrate coated with a silver halide emulsion and a magenta coupler composition comprising (a) a pyrazolotriazole magenta dye-forming coupling compound, and (b) a sulfoxide compound in an amount sufficient to improve the light stability of a magenta dye formed from the magenta dye-forming coupler compound, the sulfoxide compound being of the formula $$R_1-\overset{\overset{\displaystyle O}{\|}}{S}-R_2 \qquad 1$$

wherein $R_1$ and $R_2$ are individually selected from the group consisting of unsubstituted straight and branched chain alkyl groups, unsubstituted straight and branched chain alkenyl groups and unsubstituted straight and branched chain alkylene groups; straight and branched chain alkyl groups and straight and branched chain alkenyl groups containing at least one substituent selected from the group consisting of alkoxy, aryloxy, aryl, alkoxycarbonyl, aryloxycarbonyl, acyloxy, carbonamido and carbamoyl groups and halogen atoms; an unsubstituted phenyl group; and a phenyl group containing at least one substituent selected from the group consisting of alkyl, alkoxy, aryloxy, aryl, alkoxycarbonyl, aryloxcarbonyl, acyloxy, carbonamido and carbamoyl groups and halogen atoms; and wherein $R_1$ and $R_2$ combined contain at least 12 carbon atoms; said magenta coupler composition being free of phenol compounds.

2. A color photographic material as defined by claim 1, wherein $R_1$ and $R_2$ are the same.

3. A color photographic material as defined by claim 1, wherein $R_1$ and $R_2$ form a ring with the sulfur atom.

4. A color photographic material as defined by claim 1, wherein $R_1$ and $R_2$ combined contain at least 14 carbon atoms.

5. A color photographic material as defined by claim 1, wherein $R_1$ and $R_2$ are individually selected from the group consisting of unsubstituted straight and branched chain alkyl groups, unsubstituted straight and branched chain alkenyl groups and unsubstituted straight and branched chain alkylene groups.

6. A color photographic material as defined by claim 1, wherein $R_1$ and $R_2$ are individually selected from the group consisting of the unsubstituted branched chain alkyl groups and the substituted branched chain alkyl groups, and $R_1$ and $R_2$ combined contain from about 16 to about 24 carbon atoms.

7. A color photographic material as defined by claim 1, wherein the magenta dye-forming coupler compound is a pyrazolotriazole of a formula selected from

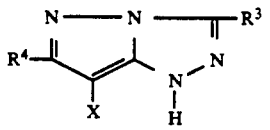

(M-1)

and

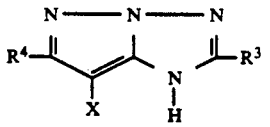

(M-2)

wherein $R^3$ and $R^4$ are individually selected from the group consisting of hydrogen, substituted and unsubstituted alkyl, substituted and unsubstituted phenyl, substituted and unsubstituted alkoxy, substituted and unsubstituted amino, substituted and unsubstituted aniline, substituted and unsubstituted acylamino, halogens and a group which links to a polymer, provided that the total number of carbon atoms contained in $R^3$ and $R^4$ is at least 10 if neither $R^3$ nor $R^4$ is a group which links to a polymer; and X is hydrogen or a coupling-off group selected from the group consisting of halogens, alkoxy, aryloxy, alkylthio, acyloxy, sulfonamido, carbonamido, arylazo, nitrogen-containing heterocyclic and imido groups.

8. A color photographic material as defined by claim 7, wherein X is a halogen.

9. A color photographic material as defined by claim 7, wherein $R^4$ is an alkyl group.

10. A color photographic material as defined by claim 7, wherein the total number of carbon atoms contained in $R^3$ and $R^4$ is from 10 to about 40.

11. A color photographic material as defined by claim 1, wherein the dye-forming coupler and the sulfoxide compound are included in a weight ratio of from about 1:0.1 to about 1:10.

12. A color photographic material as defined by claim 1, wherein the magenta coupler composition further includes a third component comprising an organic solvent.

13. A method for improving the light stability of a pyrazolotriazole magenta dye formed from a magenta dye-forming coupler compound in a color photographic developing process, comprising providing the pyrazolotriazole magenta dye-forming coupler compound in combination with a sulfoxide compound, the sulfoxide compound being included in an amount sufficient to increase the light stability of the magenta dye, the sulfoxide compound being of the formula $$R_1-\overset{\overset{\displaystyle O}{\|}}{S}-R_2$$

wherein $R_1$ and $R_2$ are individually selected from the group consisting of unsubstituted straight and branched chain alkyl groups, unsubstituted straight and branched chain alkenyl groups and unsubstituted straight and branched chain alkylene groups; straight and branched chain alkyl groups and straight and branched chain alkenyl groups containing at least one substituent selected from the group consisting of alkoxy, aryloxy, aryl, alkoxycarbonyl, aryloxycarbonyl, acyloxy, carbonamido and carbamoyl groups and halogen atoms; an unsubstituted phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined contain at least 12 carbon atoms; said combination being free of phenol compounds.

14. A method for the formation of color images, comprising (A) imagewise exposing a photographic layer, and (B) developing the exposed image, wherein the photographic layer comprises a silver halide emulsion and a magenta coupler composition comprising (a) a pyrazolotriazole magenta dye-forming coupler compound, and (b) a sulfoxide compound in an amount sufficient to improve the light stability of a magenta dye formed from the magenta dye-forming coupler compound, the sulfoxide compound being of the formula $$R_1-\overset{\overset{\displaystyle O}{\|}}{S}-R_2$$

wherein $R_1$ and $R_2$ are individually selected from the group consisting of unsubstituted straight and branched chain alkyl groups, unsubstituted straight and branched chain alkenyl groups and unsubstituted straight and branched chain alkylene groups; straight and branched chain alkyl groups and straight and branched chain alkenyl groups containing at least one substituent selected from the group consisting of alkoxy, aryloxy, aryl, alkoxycarbonyl, aryloxycarbonyl, acyloxy, carbonamido and carbamoyl groups and halogen atoms; an unsubstituted phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined contain at least 12 carbon atoms; said magenta coupler composition being free of phenol compounds.

15. A color photographic material, comprising a supporting substrate coated with a silver halide emulsion and a magenta coupler composition comprising (a) a magenta dye-forming coupler compound, and (b) a sulfone compound in an amount sufficient to improve the light stability of a magenta dye formed from the magenta dye-forming coupler compound, the sulfone compound being of the formula

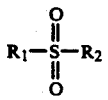

wherein $R_1$ and $R_2$ are individually selected from the group consisting of unsubstituted straight and branched chain alkyl groups and unsubstituted straight and branched chain alkylene groups; substituted straight and branched chain alkyl groups containing at least one substituent wherein substituents are selected from the group consisting of alkoxy, aryloxy, aryl, alkoxycarbonyl, acyloxy, carbonamido and carbamoyl groups; an unsubstituted phenyl group; and a substituted phenyl group containing at least one substituent wherein substituents are selected from the group consisting of alkyl, alkoxy, aryloxy, aryl, alkoxycarbonyl, aryloxycarbonyl, carbonamido and carbamoyl groups; and wherein $R_1$ and $R_2$ combined contain at least 12 carbon atoms; said magenta coupler composition being free of phenol compounds.

16. A color photographic material as defined by claim 15, wherein $R_1$ and $R_2$ are the same.

17. A color photographic material as defined by claim 15, wherein $R_1$ and $R_2$ form a ring with the sulfur atom.

18. A color photographic material as defined by claim 15, wherein $R_1$ and $R_2$ combined contain at least 14 carbon atoms.

19. A color photographic material as defined by claim 15, wherein $R_1$ and $R_2$ are individually selected from the group consisting of unsubstituted straight and branched chain alkyl groups and unsubstituted straight and branched chain alkylene groups.

20. A color photographic material as defined by claim 15, wherein $R_1$ and $R_2$ are individually selected from the group consisting of the unsubstituted branched chain alkyl groups and the substituted branched chain alkyl groups, and $R_1$ and $R_2$ combined contain from about 16 to about 24 carbon atoms.

21. A color photographic material as defined by claim 15, wherein the magenta dye-forming coupler compound is a pyrazolotriazole of a formula selected from

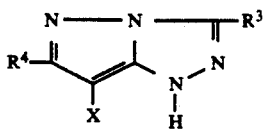

(M-1)

and

-continued

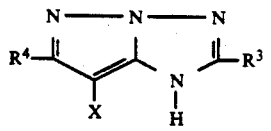

(M-2)

wherein $R^3$ and $R^4$ are individually selected from the group consisting of hydrogen, substituted and unsubstituted alkyl, substituted and unsubstituted phenyl, substituted and unsubstituted alkoxy, substituted and unsubstituted amino, substituted and unsubstituted aniline, substituted and unsubstituted acylamino, halogens and a group which links to a polymer, provided that the total number of carbon atoms contained in $R^3$ and $R^4$ is at least 10 if neither $R^3$ nor $R^4$ is a group which links to a polymer; and X is hydrogen or a coupling-off group selected from the group consisting of halogens, alkoxy, aryloxy, alkylthio, acyloxy, sulfonamido, carbonamido, arylazo, nitrogen-containing hetercyclic and imido groups.

22. A color photographic material as defined by claim 21, wherein X is a halogen.

23. A color photographic material as defined by claim 21, wherein $R^4$ is an alkyl group.

24. A color photographic material as defined by claim 21, wherein the total number of carbon atoms contained in $R^3$ and $R^4$ is from 10 to about 40.

25. A color photographic material as defined by claim 15, wherein the dye-forming coupler and the sulfone compound are included in a weight ratio of from about 1:0.1 to about 1:10.

26. A color photographic material as defined by claim 15, wherein the magenta coupler composition further includes a third component comprising an organic solvent.

27. A method for improving the light stability of a magenta dye formed from a magenta dye-forming coupler compound in a color photographic developing process, comprising providing the dye-forming coupler compound in combination with a sulfone compound, the sulfone compound being included in an amount sufficient to increase the light stability of the magenta dye, the sulfone compound being of the formula

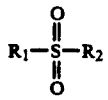

wherein $R_1$ and $R_2$ are individually selected from the group consisting of unsubstituted straight and branched chain alkyl groups, and unsubstituted straight and branched chain alkylene groups; substituted straight and branched chain alkyl groups containing at least one substituent wherein substituents are selected from the group consisting of alkoxy, aryloxy, aryl, alkoxycarbonyl, acyloxy, carbonamido and carbamoyl groups; an unsubstituted phenyl group; and a substituted phenyl group containing at least one substituent wherein substituents are selected from the group consisting of alkyl, alkoxy, aryloxy, aryl, alkoxycarbonyl, aryloxycarbonyl, carbonamido and carbamoyl groups; and wherein $R_1$ and $R_2$ combined contain at least 12 carbon atoms; said combination being free of phenol compounds.

28. A method for the formation of color images, comprising (A) imagewise exposing a photographic layer, and (B) developing the exposed image, wherein the photographic layer comprises a silver halide emulsion and a magenta coupler composition comprising (a) a magenta dye-forming coupler compound, and (b) a sulfone compound in an amount sufficient to improve the light stability of a magenta dye formed from the magenta dye-forming coupler compound, the sulfone compound being of the formula

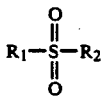

wherein $R_1$ and $R_2$ are individually selected from the group consisting of unsubstituted straight and branched chain alkyl groups and unsubstituted straight and branched chain alkylene groups; substituted straight and branched chain alkyl groups containing at least one substituent wherein substituents are selected from the group consisting of alkoxy, aryloxy, aryl, alkoxycarbonyl, acyloxy, carbonamido and carbamoyl groups; an unsubstituted phenyl group; and a substituted phenyl group containing at least one substituent wherein substituents are selected from the group consisting of alkyl, alkoxy, aryloxy, aryl, alkoxycarbonyl, aryloxycarbonyl, carbonamido and carbamoyl groups; and wherein $R_1$ and $R_2$ combined contain at least 12 carbon atoms; said magenta coupler composition being free of phenol compounds.

* * * * *